US006700987B2

(12) United States Patent
Kuze et al.

(10) Patent No.: US 6,700,987 B2
(45) Date of Patent: Mar. 2, 2004

(54) LOUDSPEAKER

(75) Inventors: Mitsukazu Kuze, Osaka (JP); Shuji Saiki, Nara (JP); Hiroyuki Takewa, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 54 days.

(21) Appl. No.: 09/934,225

(22) Filed: Aug. 21, 2001

(65) Prior Publication Data

US 2002/0051558 A1 May 2, 2002

(30) Foreign Application Priority Data

Aug. 25, 2000 (JP) ..... 2000-255062

(51) Int. Cl.[7] ..... H04R 25/00
(52) U.S. Cl. ..... 381/398; 381/396; 181/172
(58) Field of Search ..... 381/396, 398, 381/400, 403–404, 420, 423, 432, 426; 181/167, 169, 171, 172, 173, 174

(56) References Cited

U.S. PATENT DOCUMENTS 1,854,716 A * 4/1932 Pape ..... 181/171
1,943,425 A * 1/1934 Eaton ..... 181/171
1,967,223 A * 7/1934 Bostwick ..... 181/173
2,234,833 A * 3/1941 Preston ..... 381/403
2,302,178 A * 11/1942 Brennan ..... 181/169
2,358,823 A * 9/1944 O'Connor ..... 181/172
2,439,665 A * 4/1948 Marquis ..... 181/169
2,863,520 A * 12/1958 Manley ..... 181/172
3,160,716 A * 12/1964 Luth ..... 381/404
3,862,376 A * 1/1975 White ..... 381/404
4,146,756 A * 3/1979 Kito et al. ..... 381/426
4,324,312 A 4/1982 Durbin
4,646,874 A * 3/1987 Baitcher et al. ..... 181/169
5,323,469 A * 6/1994 Scholz ..... 381/403
2002/0005317 A1 * 1/2002 Ohashi et al. ..... 181/161

FOREIGN PATENT DOCUMENTS

JP 7-007790 1/1995

* cited by examiner

*Primary Examiner*—Curtis Kuntz
*Assistant Examiner*—P. Dabney
(74) *Attorney, Agent, or Firm*—RatnerPrestia

(57) ABSTRACT

A loudspeaker includes: a frame; a vibrating section including a diaphragm having an internal periphery and an external periphery, a voice coil attached to the internal periphery of the diaphragm, a spider which connects the voice coil to the frame, and a dust cap attached to the internal periphery of the diaphragm; and a surround which connects the external periphery of the diaphragm to the frame, wherein the ratio between the weight of the vibrating section and the weight of the surround is 0.9:1 to 1.5:1.

15 Claims, 18 Drawing Sheets

LOUDSPEAKER

BACKGROUND OF THE INVENTION

1. Field of the Invention

The present invention relates to a loudspeaker wherein the weight ratio between a vibrating part and a surround of the loudspeaker is adjusted to be within a predetermined range so that the loudspeaker reproduces sound of improved quality. Specifically, the present invention relates to a thin loudspeaker having a diaphragm whose height is relatively lower than its diameter so that the loudspeaker reproduces sound with improved quality.

2. Description of the Related Art

Recently, there have been increasing demands for thinner and lighter loudspeakers. In general, a loudspeaker includes a frame, a surround, a magnetic circuit section, a vibrating section, etc.

FIG. 24 is a cross-sectional view showing a structure of a conventional loudspeaker 100. The conventional loudspeaker 100 includes a voice coil 101, a diaphragm 102, a spider 103, a surround 104, a frame 105, and a dust cap 110. The voice coil 101, the diaphragm 102, the spider 103, and the dust cap 110 form a vibrating section of the conventional loudspeaker 100.

The voice coil 101 is attached to the internal periphery of the diaphragm 102 and connected to the frame 105 through the spider 103. The external periphery of the diaphragm 102 is connected to the frame 105 through the surround 104. The dust cap 110 is attached to the internal periphery of the diaphragm 102.

In the conventional loudspeaker 100, the weight ratio between the vibrating section (formed by the voice coil 101, the diaphragm 102, the spider 103, and the dust cap 110) and the surround 104 is 4:1. The diaphragm 102 has a diameter of 120 mm and a height of 12 mm (diameter:height =1:0.1).

FIG. 25 shows a sound pressure frequency characteristic of the conventional loudspeaker 100 having a structure shown in FIG. 24. In the graph of FIG. 25, the horizontal axis represents the frequency, and the vertical axis represents the sound pressure level. As seen in a region X encircled by a broken line, in the conventional loudspeaker 100, a large turbulence of the sound pressure level occurs in a middle frequency band of 200 Hz to 1 kHz. (Hereinafter, such a turbulence is referred to as "turbulence of the sound pressure level in the middle band".)

In order to improve a space factor of a loudspeaker, it is effective to reduce the height of the loudspeaker so as to obtain a thin loudspeaker. For obtaining a thin loudspeaker, it is necessary to reduce the height of a diaphragm of the loudspeaker. However, when the height of a diaphragm is reduced, the strength of the external periphery of the diaphragm decreases. In the case where an electric signal is applied to a loudspeaker which uses such a diaphragm of reduced height so as to allow the diaphragm to vibrate, a large resonance occurs at the surround of the loudspeaker and the external periphery of the diaphragm. This resonance causes a turbulence of the sound pressure level in the middle band of 200 Hz to 1 kHz.

SUMMARY OF THE INVENTION

According to one aspect of the present invention, a loudspeaker includes: a frame; a vibrating section including a diaphragm having an internal periphery and an external periphery, a voice coil attached to the internal periphery of the diaphragm, a spider which connects the voice coil to the frame, and a dust cap attached to the internal periphery of the diaphragm; and a surround which connects the external periphery of the diaphragm to the frame, wherein the ratio between the weight of the vibrating section and the weight of the surround is 0.9:1 to 1.5:1.

In one embodiment of the present invention, the ratio between the diameter of the diaphragm and the height of the diaphragm is (1:0.2) or greater.

In another embodiment of the present invention, the vibrating section further includes a connector for connecting the diaphragm and the spider to the voice coil.

In still another embodiment of the present invention, a cross-section of the surround has a generally half-circle shape; and at least one protrusion is provided on the surround.

In still another embodiment of the present invention, the at least one protrusion is provided on the surround according to a predetermined pattern along a periphery of the surround.

In still another embodiment of the present invention, the at least one protrusion is provided on the surround at random.

In still another embodiment of the present invention, at least one of the at least one protrusion has a circular shape.

In still another embodiment of the present invention, the at least one protrusion is formed of a same material as that of the surround.

In still another embodiment of the present invention, the at least one protrusion is formed of a material different from that of the surround.

In still another embodiment of the present invention, an internal loss or viscosity of a material used in the protrusion is higher than that of a material used in the surround.

In still another embodiment of the present invention, the at least one protrusion is filled with a material which has a specific gravity greater than that of the surround.

In still another embodiment of the present invention, the surround includes a first film having a cross-section of a generally half-circle shape, a second film having a cross-section of a generally half-circle shape, and at least one weight formed of a material whose density is higher than those of the first and second films; and the at least one weight is sandwiched by the first and second films.

In still another embodiment of the present invention, a gap is provided between the first and second films; and the gap is filled with a liquid, a liquid in the form of gel, or a viscoelastic body.

In still another embodiment of the present invention, the surround has a cavity which has a cross-section of a generally circular shape.

In still another embodiment of the present invention, the cavity of the surround is filled with a liquid, a liquid in the form of gel, or a viscoelastic body.

Thus, the invention described herein makes possible the advantages of providing a thin loudspeaker where the height of a diaphragm is relatively small with respect to the diameter of the diaphragm and which can produce sound with a small turbulence of the sound pressure level in the middle band.

These and other advantages of the present invention will become apparent to those skilled in the art upon reading and understanding the following detailed description with reference to the accompanying figures.

DESCRIPTION OF THE PREFERRED EMBODIMENTS

Hereinafter, embodiments of the present invention will be described with reference to FIGS. 1 through 23.

(Embodiment 1)

Figure 1:
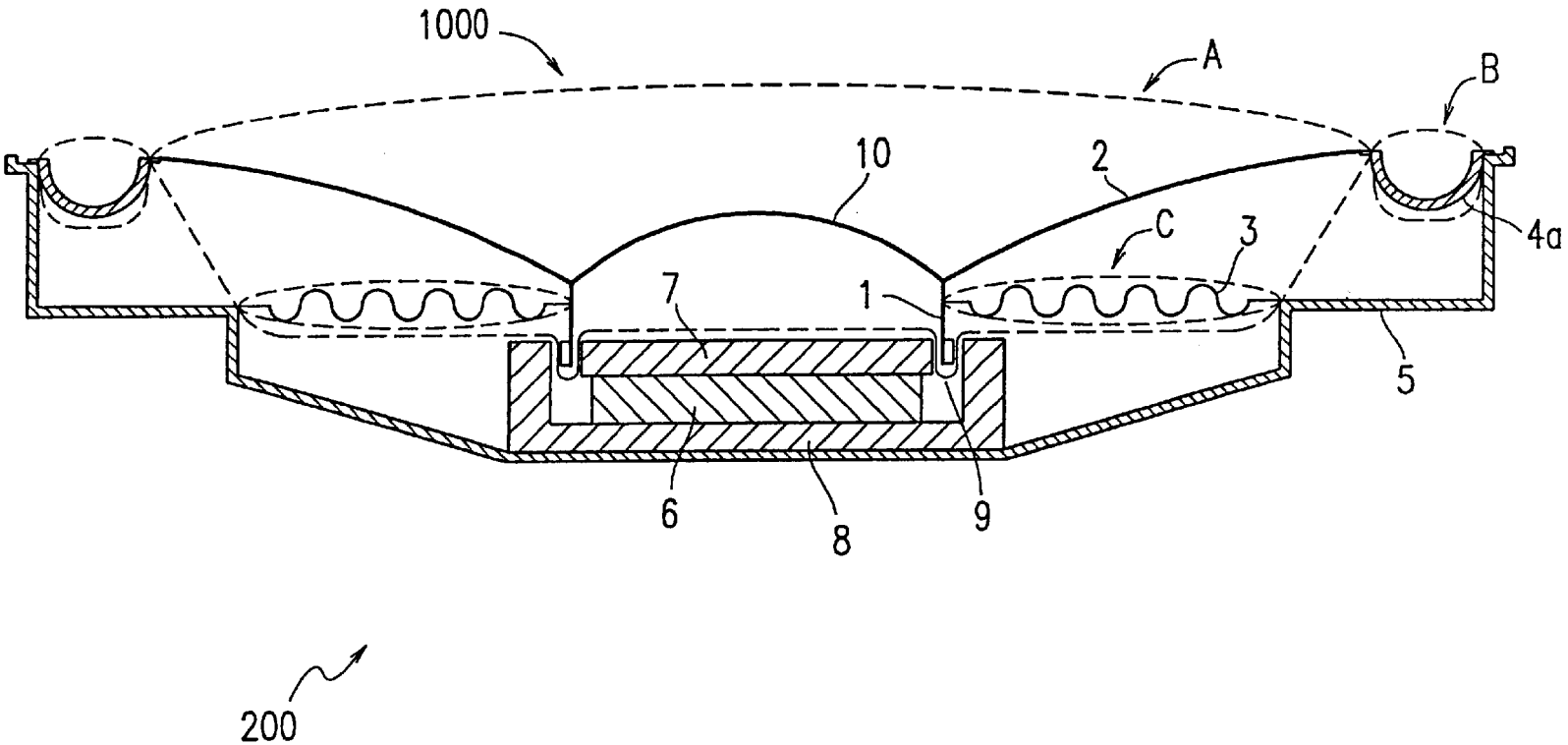
FIG. 1 is a cross-sectional view showing a structure of a loudspeaker according to embodiment 1 of the present invention.

FIG. 1 is a cross-sectional view showing a structure of a loudspeaker 200 according to embodiment 1 of the present invention.

The loudspeaker 200 includes a vibrating section 1000, and a surround 4*a*. The vibrating section 1000 includes: a diaphragm 2 having internal and external peripheries; a voice coil 1 attached to the internal periphery of the diaphragm 2; a spider 3 which connects the voice coil 1 to the frame 5; and a dust cap 10 attached to the internal periphery of the diaphragm 2. In FIG. 1, the extent of the vibrating section 1000 is represented by a region A. The external periphery of the diaphragm 2 is connected to the frame 5 through the surround 4*a*.

A bridging part between the external periphery of the diaphragm 2 and the frame 5 is defined as the surround 4*a*. The extent of the surround 4*a* is represented by a region B. A bridging part between the voice coil 1 and the frame 5 is defined as the spider 3. The extent of the spider 3 is represented by a region C. The definitions of the surround and the spider are also the same in embodiments 2–6 which will be described later.

The loudspeaker 200 further includes a magnet 6, a center pole 7, a yoke 8, and a magnetic gap 9. The magnet 6, the center pole 7, and the yoke 8 form a magnetic circuit. The magnetic circuit generates a magnetic flux in the magnetic gap 9. The voice coil 1 is inserted in the magnetic gap 9. When an electric signal is applied to the voice coil 1, the voice coil 1 vibrates, due to the magnetic flux in the magnetic gap 9, by a power which is relative to the applied electric signal. The vibration of the voice coil 1 is transmitted through the diaphragm 2, the spider 3, and the dust cap 10 to the surround 4*a*. The loudspeaker 200 vibrates up and down in a vertical direction integrally with the voice coil 1. As a result, the loudspeaker 200 reproduces sound.

In the loudspeaker 200, the weight ratio between the vibrating section 1000 and the surround 4*a* is set within a range of 0.9:1 to 1.5:1. Setting of the weight ratio between the vibrating section 1000 and the surround 4*a* is achieved by, for example, adjusting the weight of the surround 4*a*. The adjustment of the weight of the surround 4*a* can be achieved by, for example, changing the thickness or density of the surround 4*a*. Specific examples of the weight adjustment of the surround 4*a* will be described later in embodiments 3–6. Of course, according to the present invention, the weight ratio between the vibrating section 1000 and the surround 4*a* may be set within a range of 0.9:1 to 1.5:1 by adjusting the weight of the vibrating section 1000. Alternatively, the weight ratio between the vibrating section 1000 and the surround 4*a* may be set within a range of 0.9:1 to 1.5:1 by adjusting both the weight of the surround 4*a* and the weight of the vibrating section 1000.

Furthermore, in the loudspeaker 200, the cross-section of the surround 4*a* has a generally half-circle shape which protrudes downward as shown in FIG. 1. However, according to the present invention, the cross-section of the surround 4*a* may have a generally half-circle shape which protrudes upward or may have an undulated shape which is generally employed in many loudspeakers. In order to set the weight ratio between the vibrating section 1000 and the surround 4*a* within a range of 0.9:1 to 1.5:1, the thickness of the surround 4*a* may be increased, or a high-density material may be used in the surround 4*a*.

In a design of a conventional thin loudspeaker, there is no suggestion of setting the weight ratio between a vibrating section and a surround of the loudspeaker within a predetermined range. This is because it is conventionally believed that it is only necessary to use a material having a large loss factor for the surround in order to suppress a turbulence of the sound pressure level in the middle band, and that the weight of the vibrating system (vibrating section) of the loudspeaker should not be modified in view of improvement in the conversion efficiency of the loudspeaker.

Differences in design concept between a conventional thin loudspeaker and a thin loudspeaker of the present invention are now described with reference to FIG. 2.

Figure 2:
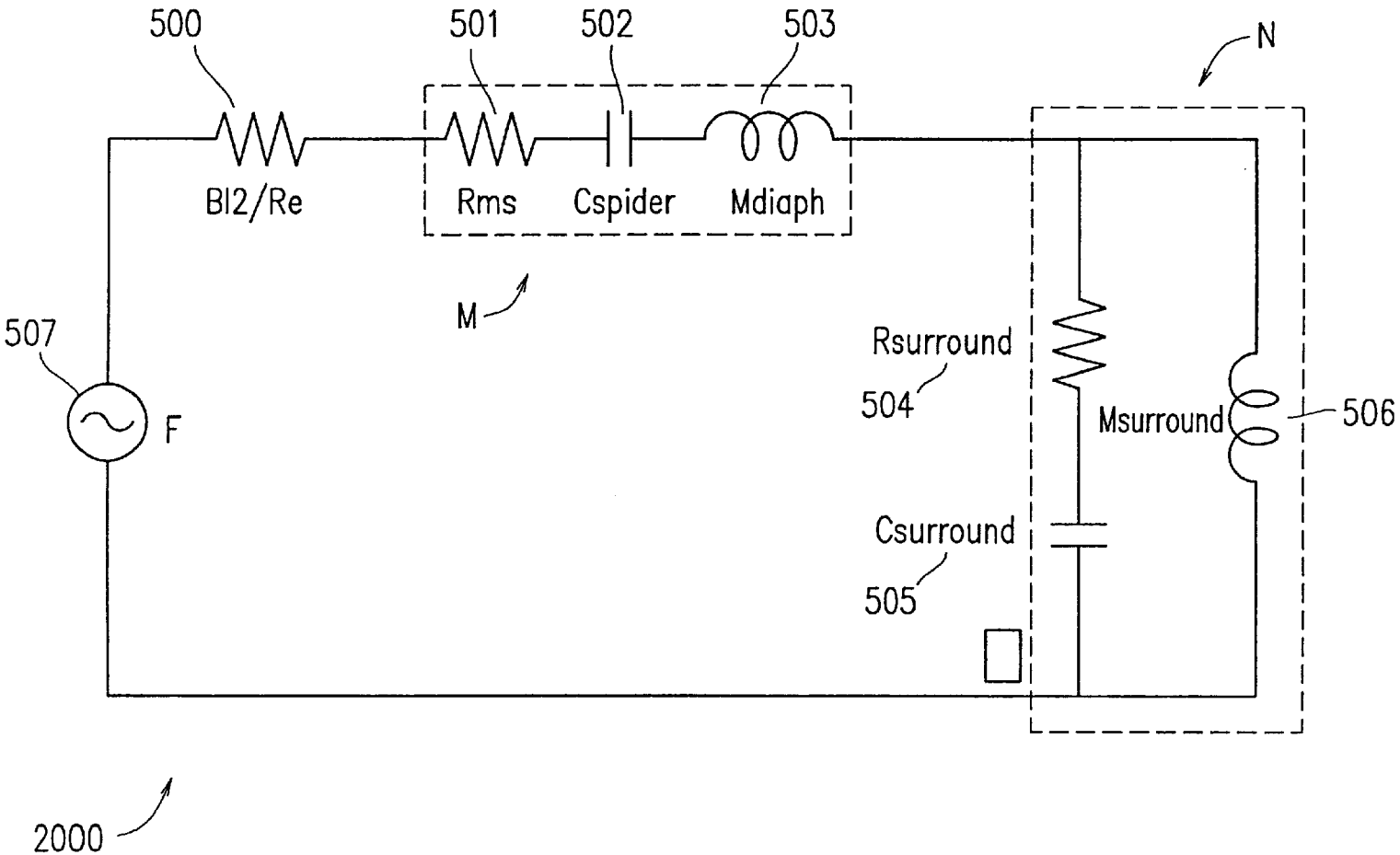
FIG. 2 shows a mechanical equivalent circuit of a loudspeaker for illustrating a mechanism of generation of a turbulence of the sound pressure level in the middle band.

FIG. 2 shows a mechanical equivalent circuit 2000 of a loudspeaker. The mechanical equivalent circuit 2000 includes: an electrodynamic resistance, B12/Re 500; a mechanical resistance of a diaphragm and a spider, Rms 501; a compliance of the spider, Cspider 502; mass of a vibrating system including the diaphragm, the spider, and a voice coil, Mdiaph 503; a mechanical resistance of a surround, Rsurround 504; a compliance of the surround, Csurround 505; mass of a vibrating system of the surround, Msurround 506; and a driving force of the loudspeaker which is generated by an electric input, F 507. In FIG. 2, a region M denotes a vibrating system (vibrating section) including the diaphragm, spider, and voice coil. A region N denotes a vibrating system of the surround. Furthermore, in the region N, a resonance caused by the Msurround 506 and the Csurround 505 is a surround resonance.

Conventionally, it is believed that in order to suppress a surround resonance in the region N, it is preferable to increase the Rsurround 504, i.e., to use a material having a large loss factor in the surround of the loudspeaker. However, in the case of a thin loudspeaker having a reduced height, a very large resonance occurs. Actually, there is no material having such a large loss factor that can suppress such a very large resonance. When the Msurround 506 is increased, i.e., the weight of the surround is increased, the mass of the vibrating system of the loudspeaker is increased, and such an increase in weight of the vibrating system may cause deterioration in the conversion efficiency of the loudspeaker. Thus, conventionally, the weight of the surround is not changed. Furthermore, in view of the purpose of reducing the weight of the loudspeaker, it is believed that a factor related to weight should not be changed.

However, the present inventors found that the surround resonance can be reduced to a very small resonance by optimizing the weight ratio between the region M and the region N. Such an idea, i.e., suppressing the turbulence of the sound pressure level in the middle band by adjusting the weight distribution among specific components of the loudspeaker, is completely novel and cannot be seen in any conventional loudspeaker, and this idea itself is the essence of the present invention.

Figure 3:
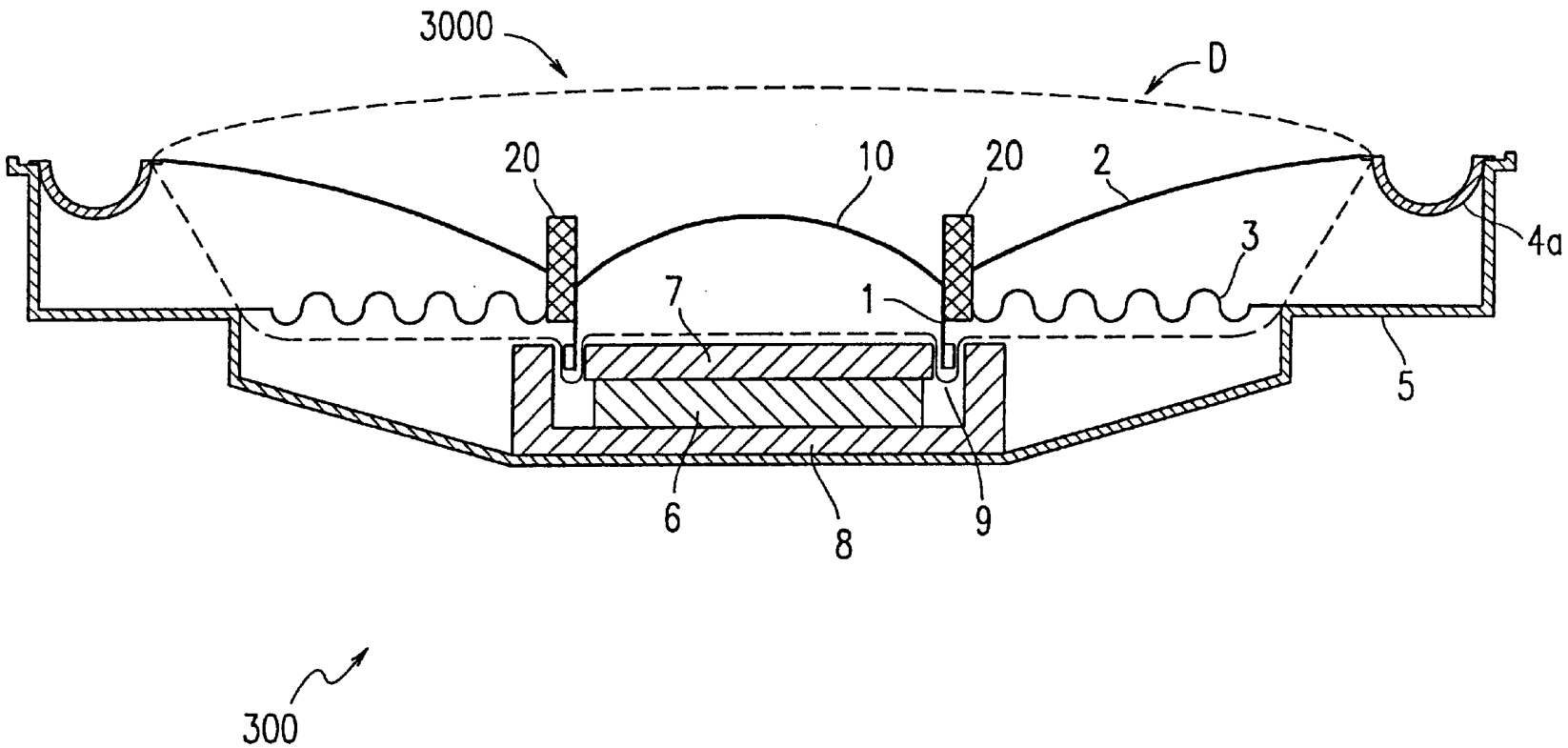
FIG. 3 is a cross-sectional view showing a structure of another loudspeaker according to embodiment 1 of the present invention.

FIG. 3 is a cross-sectional view showing a structure of a loudspeaker 300 according to embodiment 1 of the present invention.

The loudspeaker 300 of FIG. 3 is different from the loudspeaker 200 of FIG. 1 in that a vibrating section 3000 of the loudspeaker 300 includes a connector 20 in addition to the components of the vibrating section 1000 of the loudspeaker 200. The extent of the vibrating section 3000 is represented by a region D.

The connector 20 connects a diaphragm 2 and a spider 3 to a voice coil 1. The connector 20 is formed integrally with the vibrating section 3000.

The components of the vibrating section 3000 are not limited to the voice coil 1, the diaphragm 2, the spider 3, and a dust cap 10. Any element can be a component of the vibrating section 3000 as long as the element is formed integrally with the vibrating section 3000. Also in the loudspeaker 300, the weight ratio between the vibrating section 3000 and the surround 4*a* is set within a range of 0.9:1 to 1.5:1, whereby the same effect as that produced by the loudspeaker 200 (FIG. 1) can be obtained.

Figure 4:
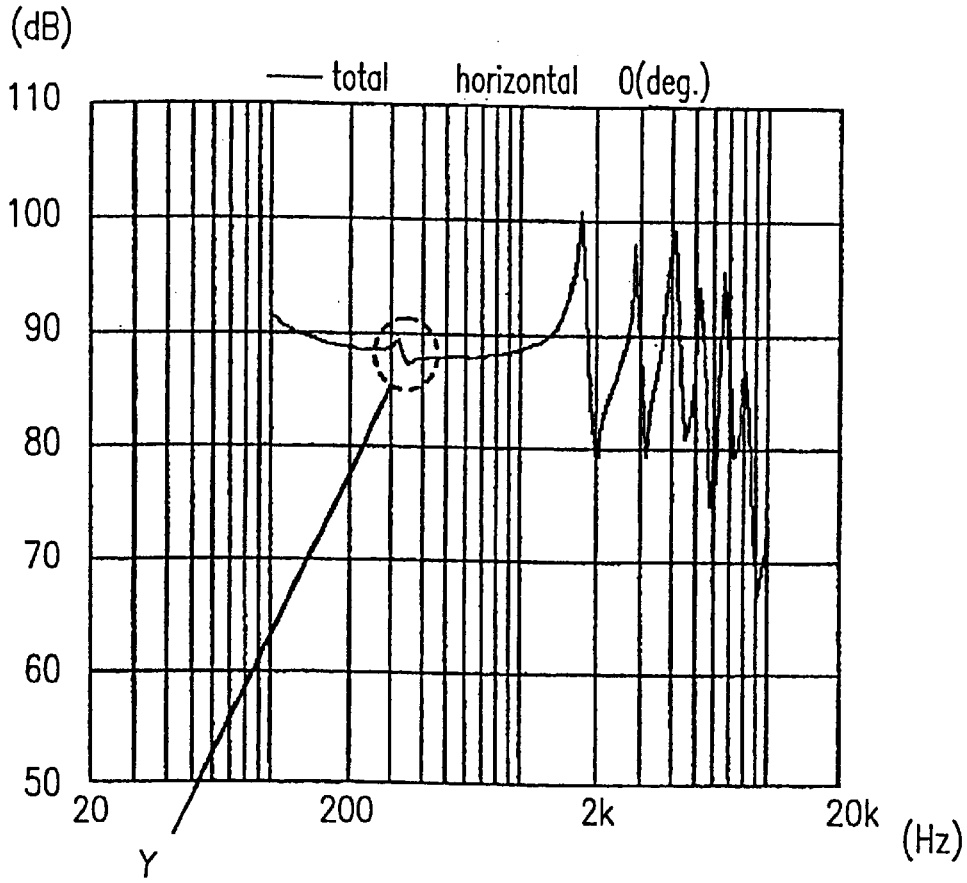
FIG. 4 shows a sound pressure frequency characteristic of the loudspeaker according to embodiment 1 of the present invention.

FIG. 4 shows a sound pressure frequency characteristic of the loudspeaker 200 when the weight ratio between the vibrating section 1000 and the surround 4*a* is set to 1.1:1. In the graph of FIG. 4, the horizontal axis represents the frequency, and the vertical axis represents the sound pressure level. In FIG. 4, the sound pressure level in the middle frequency band is shown in a region Y encircled by a broken line. As seen from the region Y, a turbulence of the sound pressure level in the middle band is very small, i.e., the sound pressure level in the middle band is a generally "flat" characteristic. Herein, "flat" may not be exactly flat, but is flat in a practical use.

Figure 5:
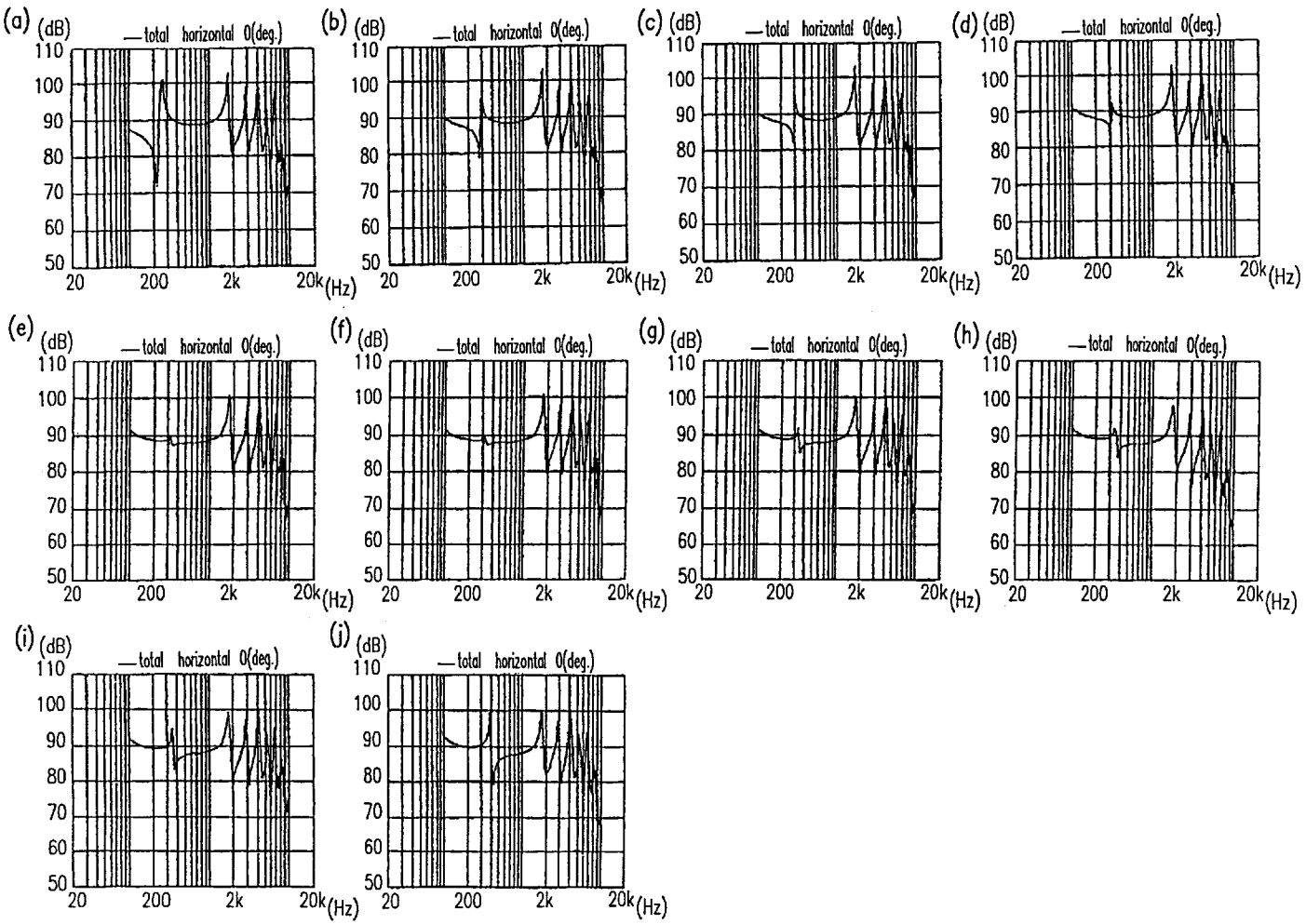
FIG. 5 shows a sound pressure frequency characteristic of the loudspeaker according to embodiment 1 of the present invention when the weight ratio between a vibrating section and a surround of the loudspeaker is changed within a range of 0.5:1 to 2:1.

Parts (a)–(j) of FIG. 5 show a sound pressure frequency characteristic of the loudspeaker 200 when the weight ratio between the vibrating section 1000 and the surround 4*a* is changed within a range of 0.5:1 to 2:1. In part (a), the weight ratio is 0.5:1; in part (b), 0.8:1; in part (c), 0.9:1; in part (d), 1:1; in part (e), 1.1:1; in part (f), 1.2:1; in part (g), 1.3:1; in part (h), 1.4:1; in part (i), 1.5:1; in part (j), 2:1.

Herein, in the case where the peak-dip difference of the sound pressure level in the middle band of 200 Hz to 1 kHz is within ±6 dB, the sound pressure frequency characteristic is "flat" in a practical use. As seen from parts (c)–(i) of FIG. 5, when the weight ratio between the vibrating section 1000 and the surround 4*a* is be within a range of 0.9:1 to 1.5:1, a "flat" sound pressure frequency characteristic can be obtained. When the weight ratio is 1.1:1 or 1.2:1, a "flattest" sound pressure frequency characteristic can be obtained. In the examples illustrated in parts (a)–(j), the sound pressure frequency characteristic is shown for each of a plurality of preselected weight ratios. However, it is needless to say that the sound pressure frequency characteristic continuously changes between adjacent two of the preselected weight ratios. Thus, a practically "flat" sound pressure frequency characteristic can be obtained at any weight ratio within a range of 0.9:1 to 1.5:1.

(Embodiment 2)

Figure 6:
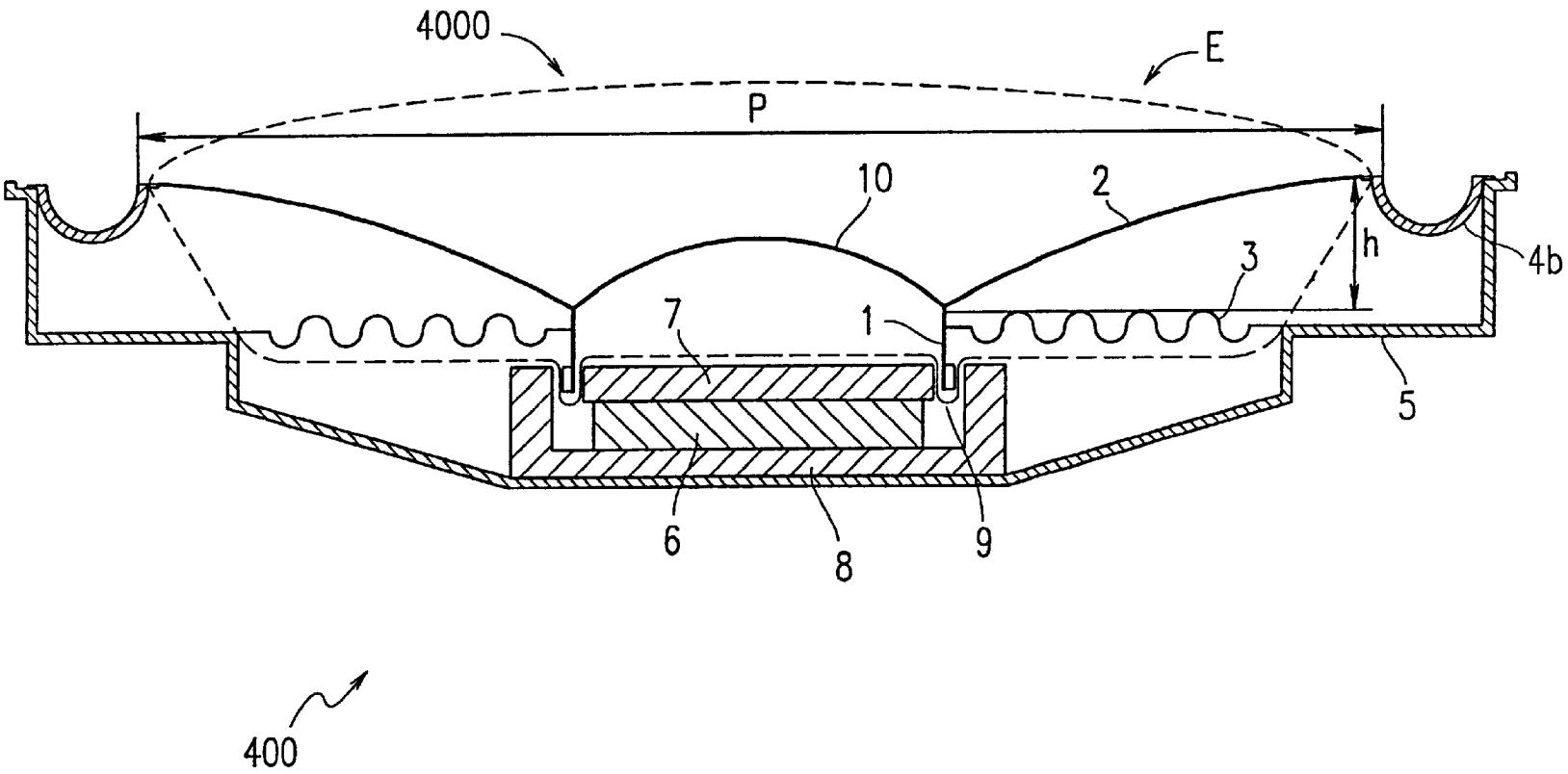
FIG. 6 is a cross-sectional view showing a structure of a loudspeaker according to embodiment 2 of the present invention.

FIG. 6 is a cross-sectional view showing a structure of a loudspeaker 400 according to embodiment 2 of the present invention.

The loudspeaker 400 includes a vibrating section 4000, and a surround 4*b*. The vibrating section 4000 includes: a diaphragm 2 having internal and external peripheries; a voice coil 1 attached to the internal periphery of the diaphragm 2; a spider 3 which connects the voice coil 1 to the frame 5; and a dust cap 10 attached to the internal periphery of the diaphragm 2. In FIG. 6, the extent of the vibrating section 4000 is represented by a region E. The external periphery of the diaphragm 2 is connected to the frame 5 through the surround 4*b*.

The loudspeaker 400 further includes a magnet 6, a center pole 7, a yoke 8, and a magnetic gap 9. The magnet 6, the center pole 7, and the yoke 8 form a magnetic circuit. This magnetic circuit generates a magnetic flux in the magnetic gap 9. The voice coil 1 is inserted in the magnetic gap 9. When an electric signal is applied to the voice coil 1, the voice coil 1 vibrates, due to the magnetic flux in the magnetic gap 9, by a power which is relative to the applied electric signal. The vibration of the voice coil 1 is transmitted through the diaphragm 2, the spider 3, and the dust cap 10 to the surround 4*b*. The loudspeaker 400 vibrates up and down in a vertical direction integrally with the voice coil 1. As a result, the loudspeaker 400 reproduces sound.

In the loudspeaker 400, the weight ratio between the vibrating section 4000 and the surround 4*b* is set within a range of 0.9:1 to 1.5:1. Setting of the weight ratio between the vibrating section 4000 and the surround 4*b* is achieved by, for example, adjusting the weight of the surround 4*b*. The adjustment of the weight of the surround 4*b* can be achieved by, for example, changing the thickness or density of the surround 4*b*. Alternatively, the weight ratio between the vibrating section 4000 and the surround 4*b* may be set within a range of 0.9:1 to 1.5:1 by adjusting the weight of the vibrating section 4000 or by adjusting both the weight of the surround 4*b* and the weight of the vibrating section 4000.

Furthermore, in the loudspeaker 400, the ratio between the diameter p of the diaphragm 2 and the height h of the diaphragm 2 is set to (1:0.2) or greater.

Further still, in the loudspeaker 400, the cross-section of the surround 4*b* has a generally half-circle shape which protrudes downward as shown in FIG. 6. However, according to the present invention, the cross-section of the surround 4*b* may have a generally half-circle shape which protrudes upward or may have an undulated shape which is generally employed in many loudspeakers. In order to set the weight ratio between the vibrating section 4000 and the surround 4*b* within a range of 0.9:1 to 1.5:1, the thickness of the surround 4*b* may be increased, or a high-density material may be used in the surround 4*b*.

Thus, the loudspeaker 400 has substantially the same structure as that of the loudspeaker 200 shown in FIG. 1 except that in the loudspeaker 400, the ratio between the diameter p of the diaphragm 2 and the height h of the diaphragm 2 is set to (1:0.2) or greater.

Figure 7:
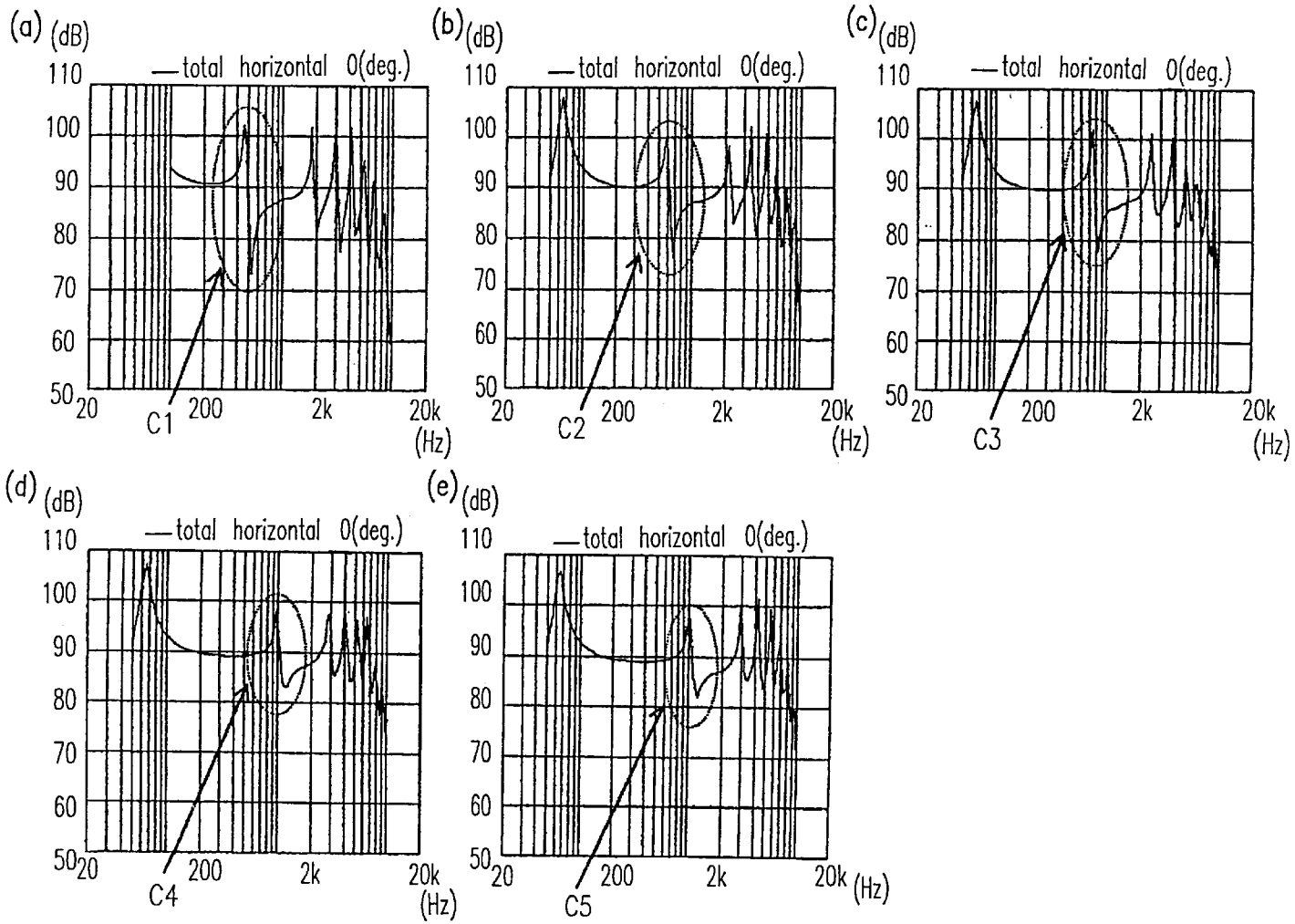
FIG. 7 show a sound pressure frequency characteristic of a conventional loudspeaker when the ratio between the diameter p and the height h of a diaphragm is changed within a range of 1:0.1 to 1:0.3.

Parts (a)–(e) of FIG. 7 show a sound pressure frequency characteristic of the conventional loudspeaker 100 (FIG. 24) where the weight ratio between the vibrating section and the surround is 4:1 when the ratio between the diameter and the height of the diaphragm is changed within a range of 1:0.1 to 1:0.3. In part (a), the ratio between diameter and height is 1:0.1; in part (b), 1:0.15; in part (c), 1:0.2; in part (d), 1:0.25; in part (e), 1:0.3. In parts (a)–(e) of FIG. 7, shown in each of regions C1–C5 is a turbulence of the sound pressure level in the middle band of 200 Hz to 1 kHz which is caused by a resonance of the surround and the external periphery of the diaphragm.

As seen in parts (a)–(c) of FIG. 7, when the ratio between the diameter p and the height h of the diaphragm is (1:0.2) or greater, the peak-dip difference of the sound pressure level in the middle band of 200 Hz to 1 kHz is ±6 dB or more. Thus, in the case of using a thin diaphragm where the ratio between the diameter p and height h of the diaphragm is (1:0.2) or greater, it is necessary to remove the turbulence of the sound pressure level in the middle band.

According to the present invention, even in a loudspeaker which uses a thin diaphragm where the ratio between the diameter and height of the diaphragm is (1:0.2) or greater, a turbulence of the sound pressure level in the middle band, which results from a resonance of the surround of the loudspeaker, can be reduced by setting the weight ratio between the vibrating section and the surround so as to be within a range of 0.9:1 to 1.5:1.

Figure 8:
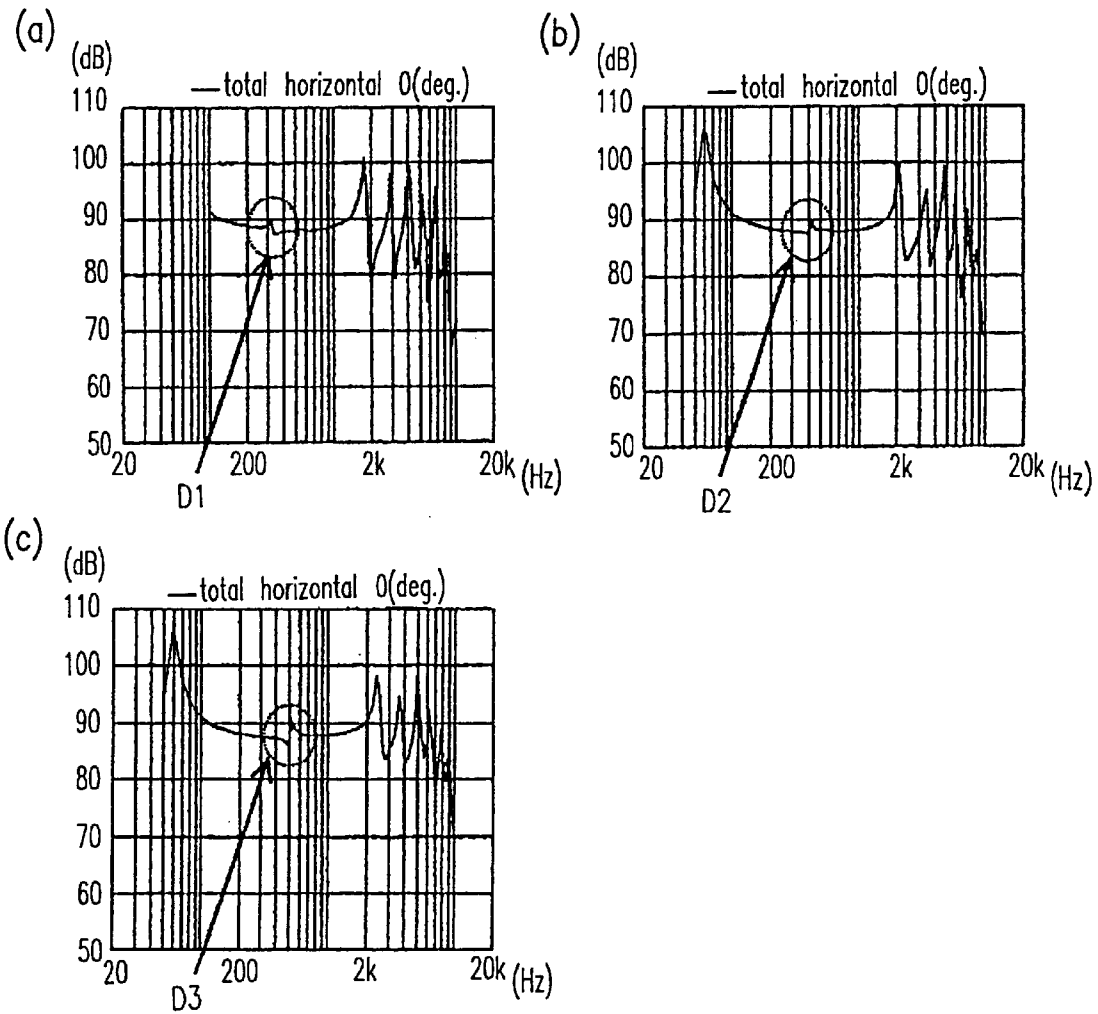
FIG. 8 show a sound pressure frequency characteristic of the loudspeaker according to embodiment 2 where the weight ratio between a vibrating section and a surround is 1.2:1 when the ratio between the diameter p and the height h of a diaphragm is changed.

Parts (a)–(c) of FIG. 8 show a sound pressure frequency characteristic of the loudspeaker 400 (FIG. 6) where the weight ratio between the vibrating section 4000 and the surround 4*b* is 1.2:1 when the ratio between the diameter p and the height h of the diaphragm 2 is changed within a range of 1:0.1 to 1:0.2. In part (a), the ratio between diameter and height is 1:0.1; in part (b), 1:0.15; in part (c), 1:0.2. In parts (a)–(c) of FIG. 8, shown in each of regions D1–D3 is a turbulence of the sound pressure level in the middle band of 200 Hz to 1 kHz which is caused by a resonance of the surround 4*b* and the external periphery of the diaphragm 2.

According to the present invention, the turbulence of the sound pressure level in the middle band seen in each of regions C1–C3 in parts (a)–(c) of FIG. 7 is reduced as shown in each of regions D1–D3 in parts (a)–(c) of FIG. 8. That is, according to the present invention, a generally "flat" sound pressure frequency characteristic can be obtained.

(Embodiment 3)

Figure 9:
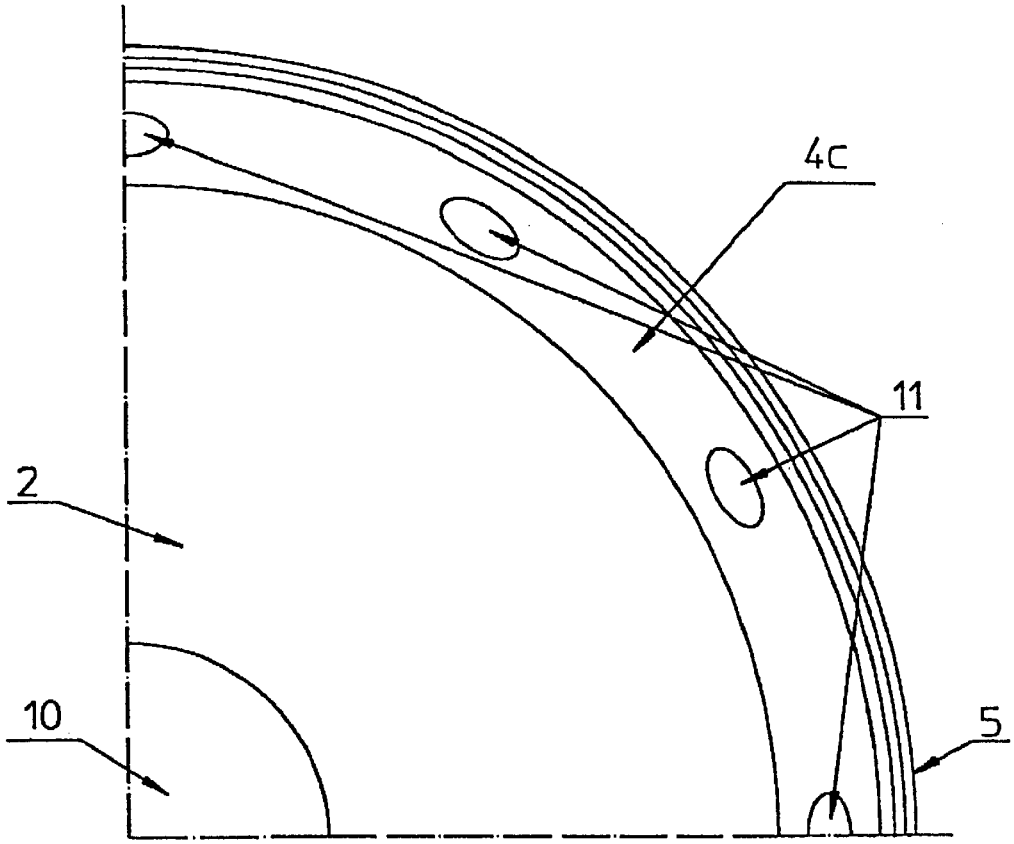
FIG. 9 is an upper view of a surround of a loudspeaker according to embodiment 3 of the present invention.
Figure 10:
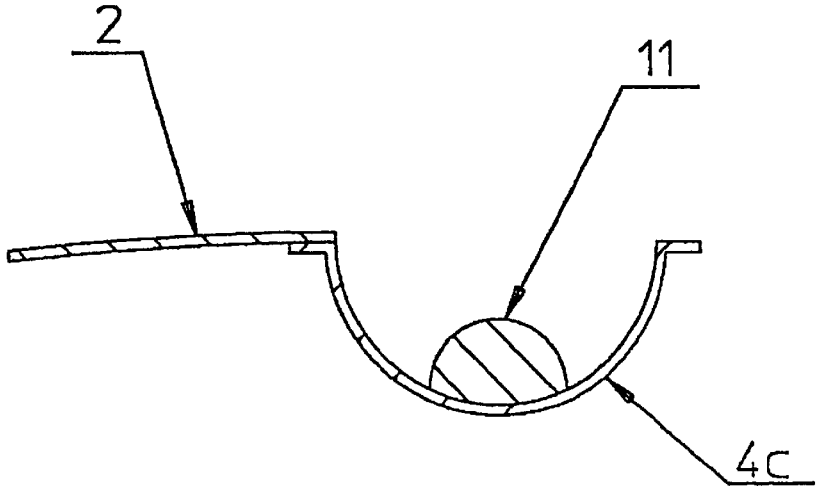
FIG. 10 is a cross-sectional view of the surround of the loudspeaker shown in FIG. 9.

FIG. 9 is an upper view of a surround 4*c* of a loudspeaker according to embodiment 3 of the present invention. FIG. 10 is a cross-sectional view of the surround 4*c*. The upper surface of the surround 4*c* has protrusions 11.

In the loudspeaker of embodiment 3, the ratio between the diameter and the height of a diaphragm of the loudspeaker is set to (1:0.2) or greater.

Furthermore, the weight ratio between the vibrating section and the surround 4*c* is set so as to be within a range of 0.9:1 to 1.5:1 by providing the protrusions 11 on the upper surface of the surround 4*c*. With such a method for setting the weight ratio, a turbulence of the sound pressure level in the middle band, which occurs in a conventional loudspeaker using a thin-shaped diaphragm with a reduced height, can be removed, whereby a "flat" sound pressure frequency characteristic can be obtained. This effect is the same as those produced by the loudspeakers of embodiments 1 and 2.

Furthermore, by providing the protrusions 11 on the surface of the surround 4*c*, the weight ratio between the vibrating section and the surround 4*c* can be adjusted without increasing the thickness of the surround 4*c* or using a high-density material in the surround 4*c*. Thus, in the loudspeaker of embodiment 3, the compliance of the surround can be freely designed as compared with the loudspeaker of embodiment 1. As a result, adjustment of a minimum resonance frequency of the loudspeaker can be readily performed.

Figure 24:
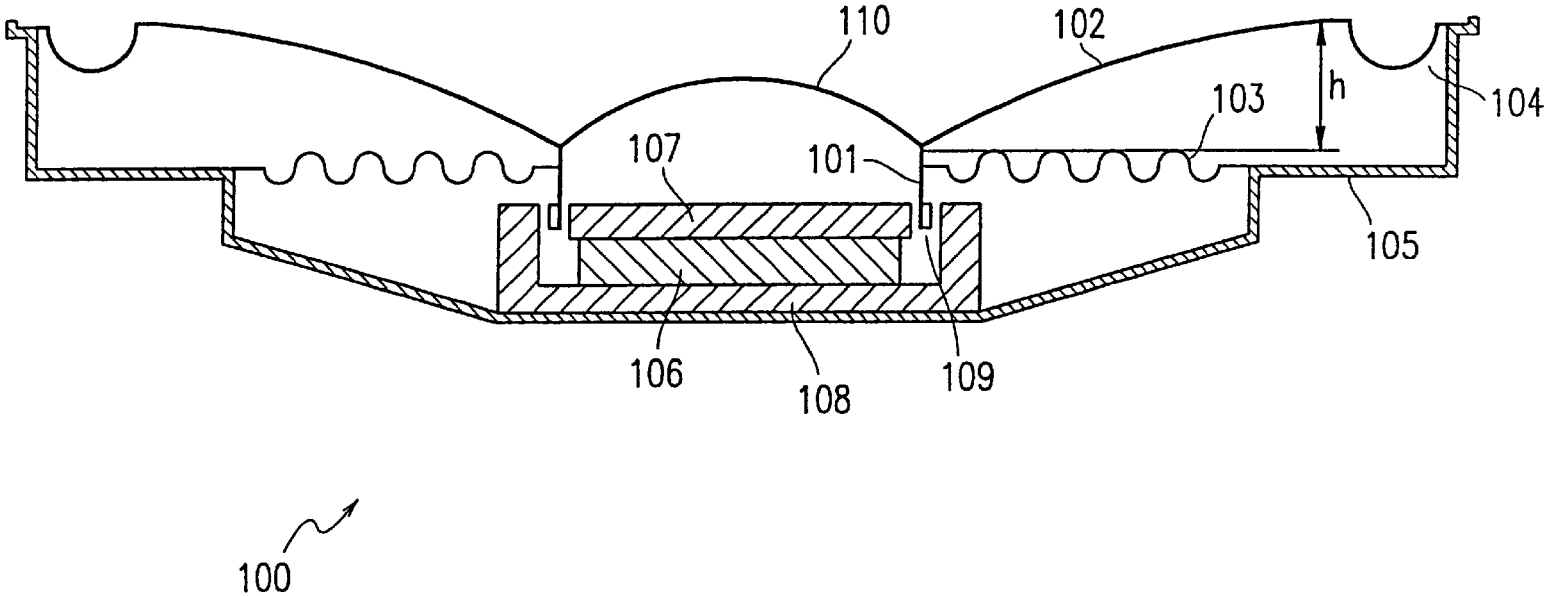
FIG. 24 is a cross-sectional view showing a structure of a conventional loudspeaker.
Figure 25:
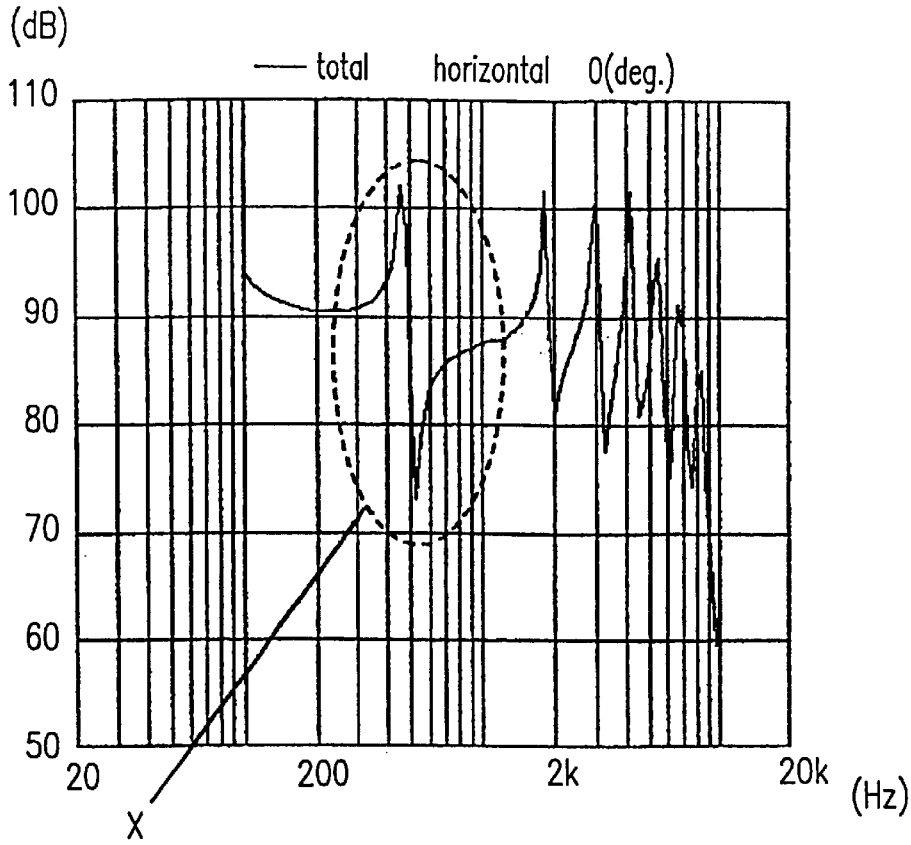
FIG. 25 shows a sound pressure frequency characteristic of the conventional loudspeaker shown in FIG. 24.

If the cross-section of the surround has a uniform thickness as shown in the loudspeaker 100 of FIG. 24, a single resonance occurs along a radial direction of the surround, and this resonance deteriorates the quality of sound reproduced by the loudspeaker. However, in the loudspeaker of embodiment 3, the thickness of the cross-section of the surround 4*c* is not uniform, and accordingly, an undesirable resonance which may occur in the surround can be dispersed. Therefore, an adverse effect by the surround resonance on the characteristics of the loudspeaker is reduced, whereby the quality of sound reproduced by the loudspeaker can be improved.

Figure 11:
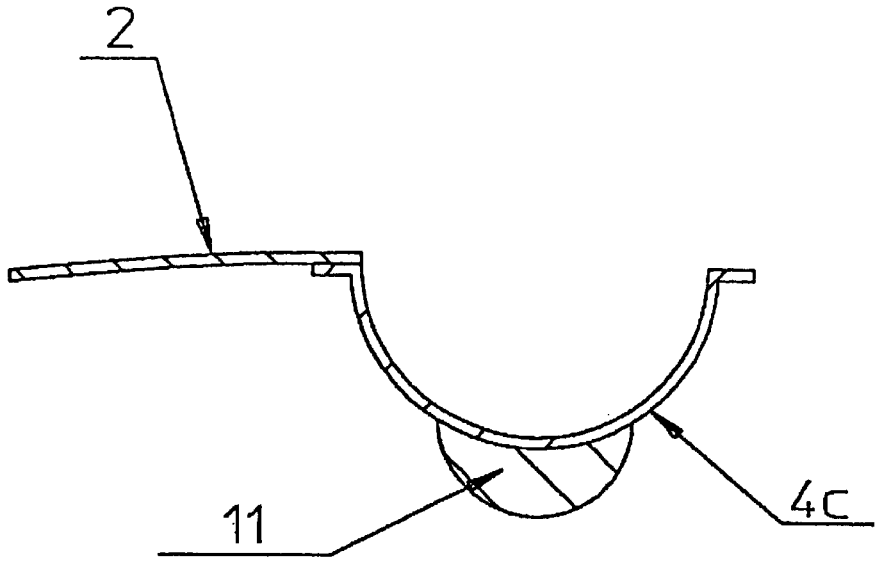
FIG. 11 is a cross-sectional view showing a variation of the surround of the loudspeaker shown in FIG. 10.

In the example illustrated in FIG. 10, the protrusion 11 is provided on the concave surface of the surround 4*c*. However, the protrusion 11 may be provided on the convex surface of the surround 4*c* as shown in FIG. 11.

Figure 12:
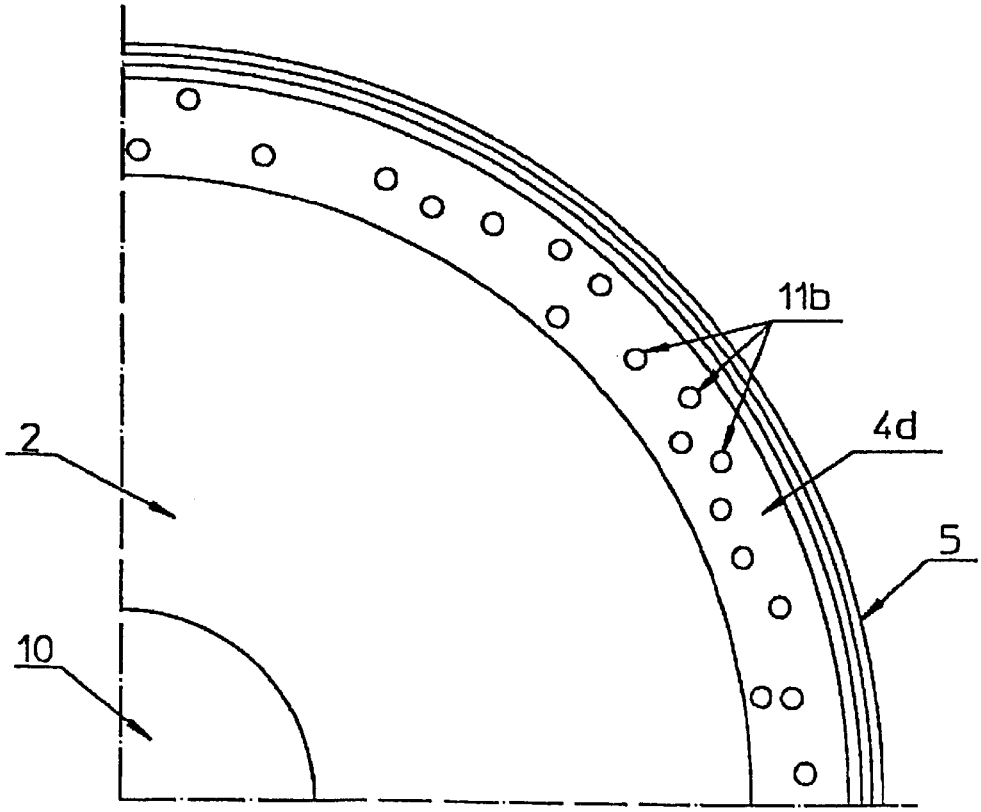
FIG. 12 is an upper view showing another example of the surround of the loudspeaker according to embodiment 3 of the present invention.
Figure 13:
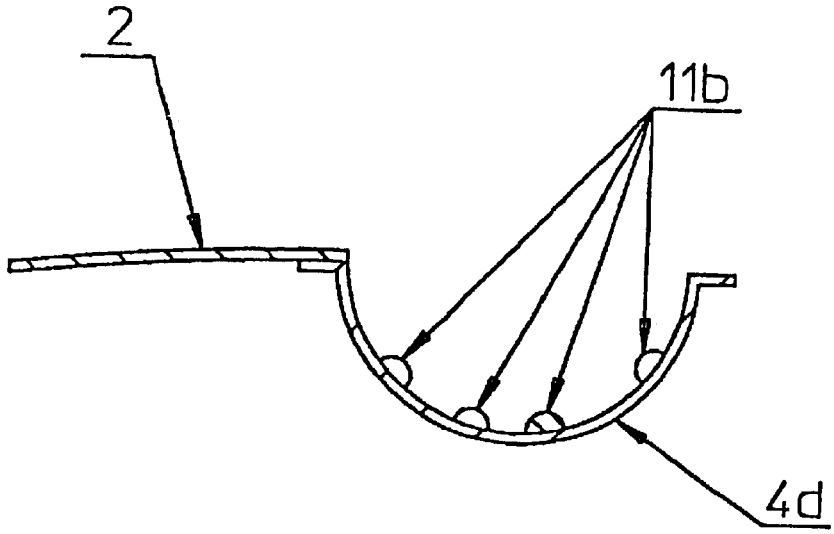
FIG. 13 is a cross-sectional view of the surround of the loudspeaker shown in FIG. 12.
Figure 14:
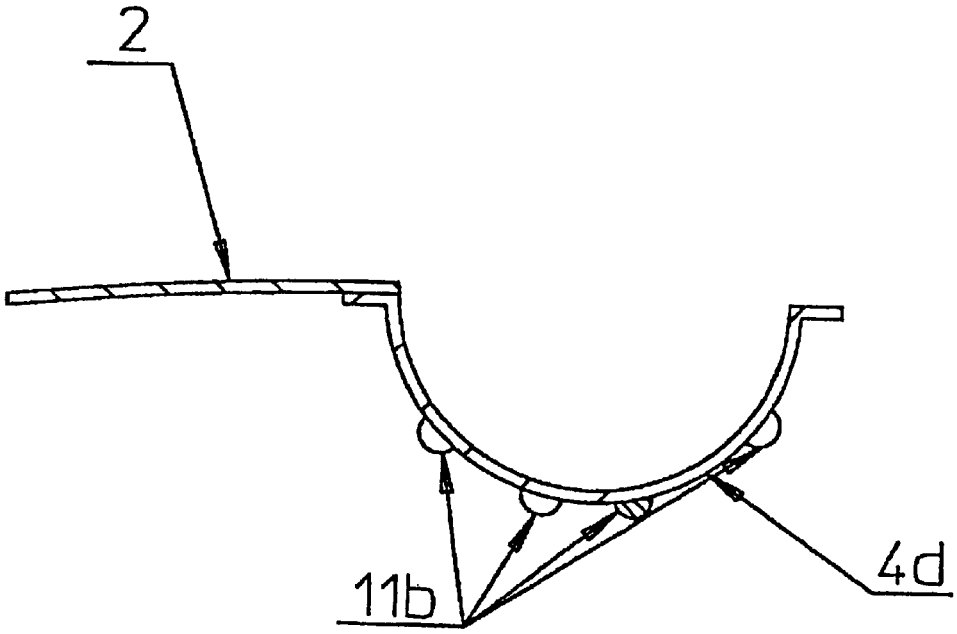
FIG. 14 is a cross-sectional view showing a variation of the surround of the loudspeaker shown in FIG. 13.

Furthermore, the protrusions may be provided according to a predetermined pattern along a periphery of the surround. (For example, in FIG. 9, the protrusions 11 are provided at equal intervals along the periphery of the surround 4*c*.) Alternatively, as shown in FIG. 12 (upper view of a surround 4*d*) and FIG. 13 (cross-sectional view of the surround 4*d*), protrusions 11*b* may be provided on the surround 4*d* at random. In such an arrangement, the thickness of the cross-section of the surround 4*d* is not uniform, and accordingly, an undesirable resonance which may occur in the surround 4*d* can be dispersed. As a result, the quality of sound reproduced by the loudspeaker can be improved. In the example illustrated in FIG. 13, the protrusions 11*b* are provided on the concave surface of the surround 4*d*. However, the protrusions 11*b* may be provided on the convex surface of the surround 4*d* as shown in FIG. 14.

Figure 15:
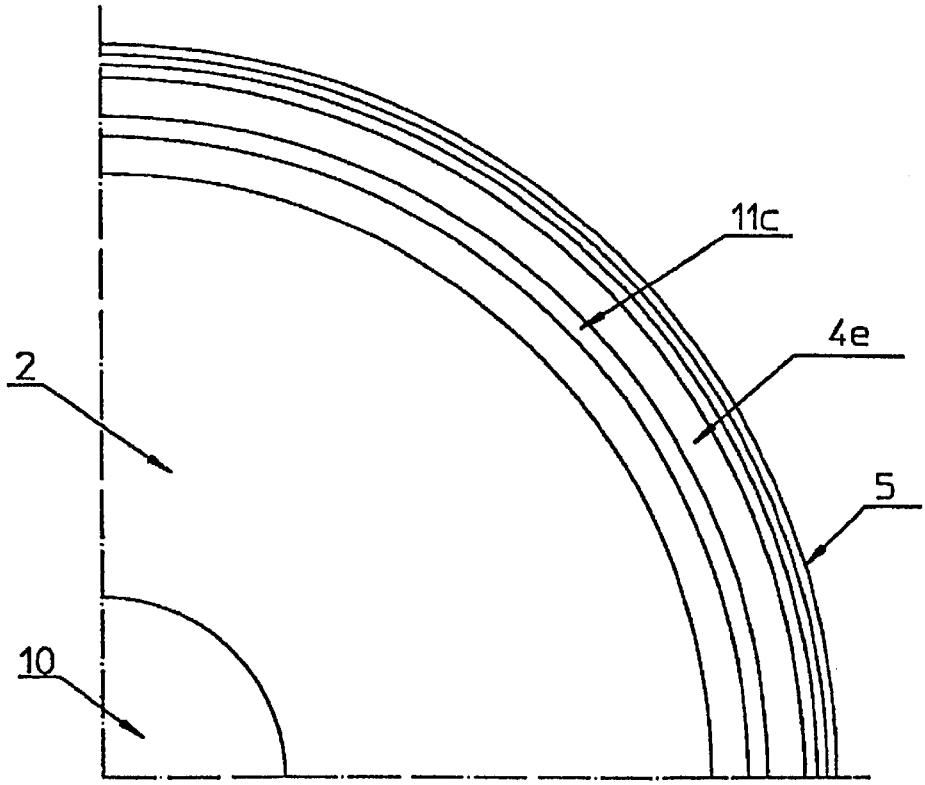
FIG. 15 is an upper view showing still another example of the surround of the loudspeaker according to embodiment 3 of the present invention.
Figure 16:
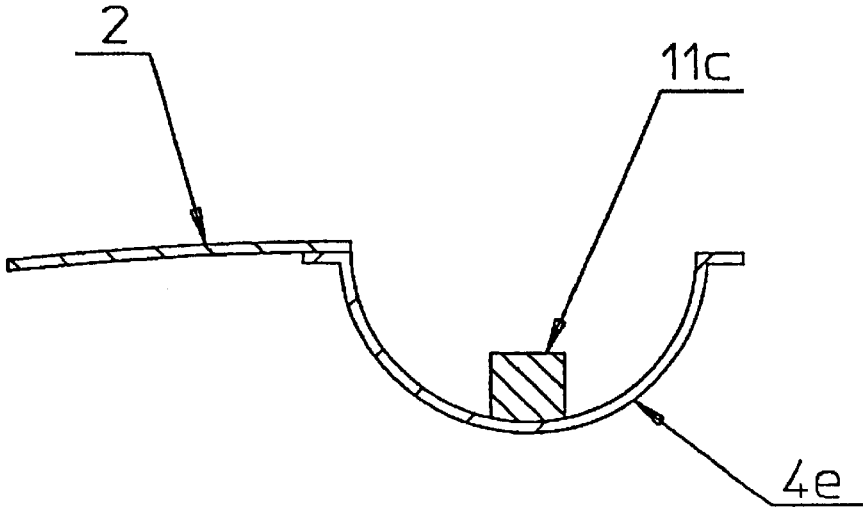
FIG. 16 is a cross-sectional view of the surround of the loudspeaker shown in FIG. 15.
Figure 17:
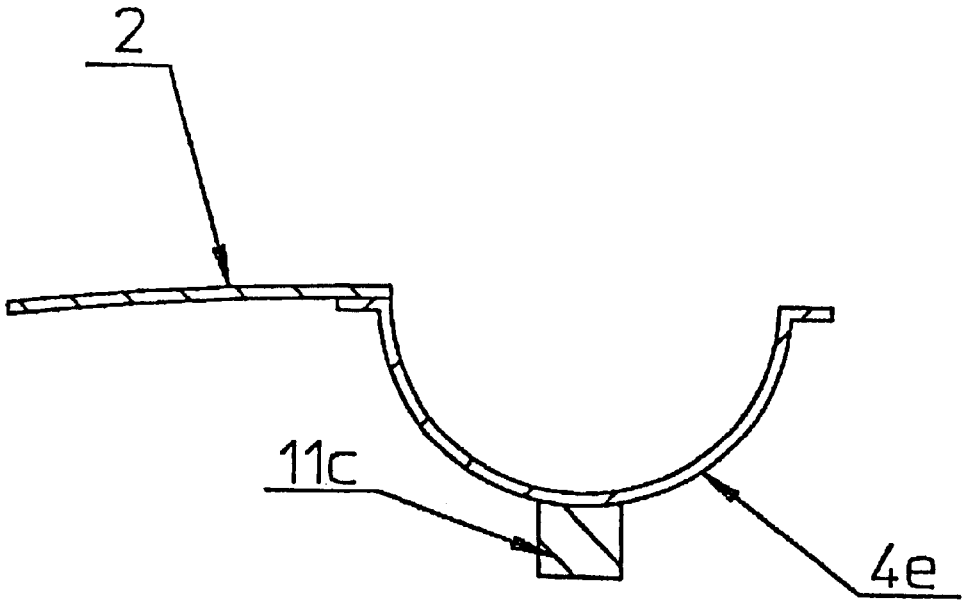
FIG. 17 is a cross-sectional view showing a variation of the surround of the loudspeaker shown in FIG. 16.

Furthermore, as shown in FIG. 15 (upper view of a surround 4*e*) and FIG. 16 (cross-sectional view of the surround 4*e*), a protrusion 11*c* in the shape of a circle is provided on the surround 4*e* concentrically with the surround 4*e*. In such an arrangement, an undesirable resonance in the surround 4*e* is dispersed. As a result, the quality of sound reproduced by the loudspeaker can be improved. In the example illustrated in FIG. 16, the protrusion 11*c* is provided on the concave surface of the surround 4*e*. However, the protrusion 11*c* may be provided on the convex surface of the surround 4*e* as shown in FIG. 17.

Furthermore, the protrusion may be formed of a same material (e.g., foamed rubber) as that of the surround and formed integrally with the surround. Alternatively, the protrusion may be formed of a material different from that of the surround and then attached to the surround. In the latter case, if the protrusion is formed of a high-density material (e.g., a metal), the weight of the surround can be readily adjusted. If the protrusion is formed of a material having a high internal loss or a material having a high viscosity (e.g., butyl rubber), an effect of suppressing an undesirable resonance in the surround can be obtained.

(Embodiment 4)

Figure 18:
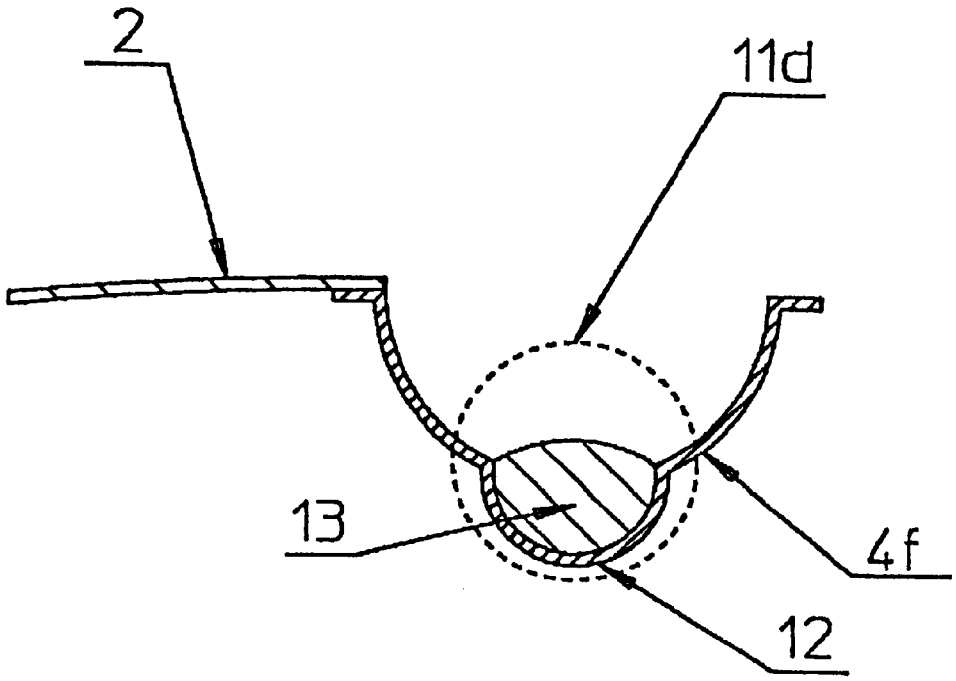
FIG. 18 is a cross-sectional view of a surround of a loudspeaker according to embodiment 4 of the present invention.

FIG. 18 is a cross-sectional view of a surround 4*f* of a loudspeaker according to embodiment 4 of the present invention. The loudspeaker of embodiment 4 has substantially the same structure as that of the loudspeaker 200 according to embodiment 1 shown in FIG. 1 except for the surround 4*f*. In FIG. 18, a reference numeral 11*d* denotes a protrusion, a reference numeral 12 denotes a surface of the protrusion 11*d* which is formed integrally with the surround 4*f*, and a reference numeral 13 denotes a filling material having a specific gravity larger than that of the material of the surround 4*f*. Furthermore, in the loudspeaker of embodiment 4, the ratio between the diameter p and the height h of a diaphragm 2 is set to (1:0.2) or greater.

In the loud speaker of embodiment 4, the surround 4*f* has the protrusion 11*d*, and the protrusion 11*d* is filled with the filling material 13 which has a specific gravity greater than that of a material of the surround 4*f* such that the weight ratio between the vibrating part and the surround 4*f* is set so as to be within a range of 0.9:1 to 1.5:1. With such a setting of the weight ratio, a turbulence of the sound pressure level in the middle band, which occurs in a conventional loudspeaker using a thin-shaped diaphragm with a reduced height, can be removed, whereby a "flat " sound pressure frequency characteristic can be obtained. This effect is the same as those produced by the loudspeakers of embodiments 1 and 2. When a material having a high internal loss or a material having a high viscosity (e.g., silicon or the like), an effect of suppressing an undesirable resonance in the surround 4*f* can be obtained, whereby the quality of sound reproduced by the loudspeaker can be further improved.

Figure 19:
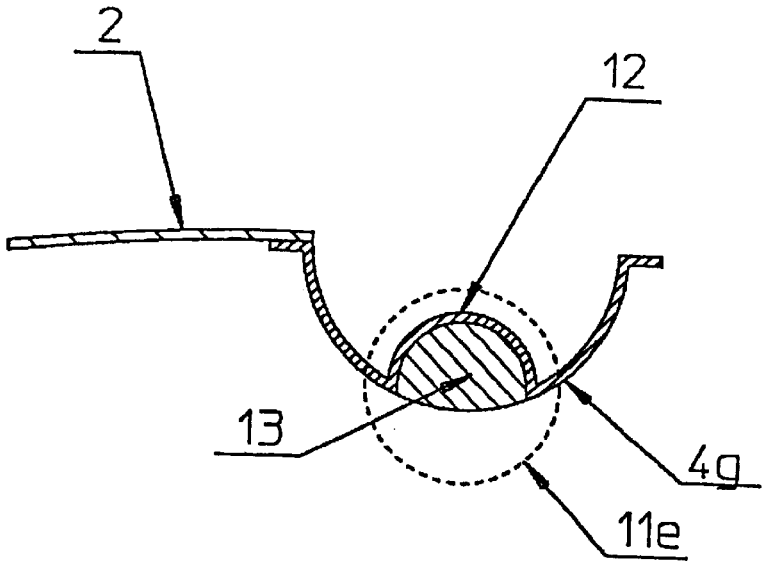
FIG. 19 is a cross-sectional view showing a variation of the surround of the loudspeaker shown in FIG. 18.

In the example illustrated in FIG. 18, the protrusion 11*d* is formed so as to protrude from the convex surface of the surround 4*f*. However, the protrusion may be formed so as to protrude from the concave surface of the surround as shown in FIG. 19. The filling material 13 stuffed in a protrusion 11*e* of a surround 4*g* does not drop from the protrusion 11*e* so long as a material having a relatively high viscosity is used as the filling material 13. Thus, a loudspeaker which provides a stable performance can be easily fabricated.

The shape and material of the surround of the loudspeaker shown in each of FIGS. 9 through 19 are appropriately selected in view of the design of a compliance of a surround, easiness of production, the appearance of the loudspeaker, etc.

(Embodiment 5)

Figure 20:
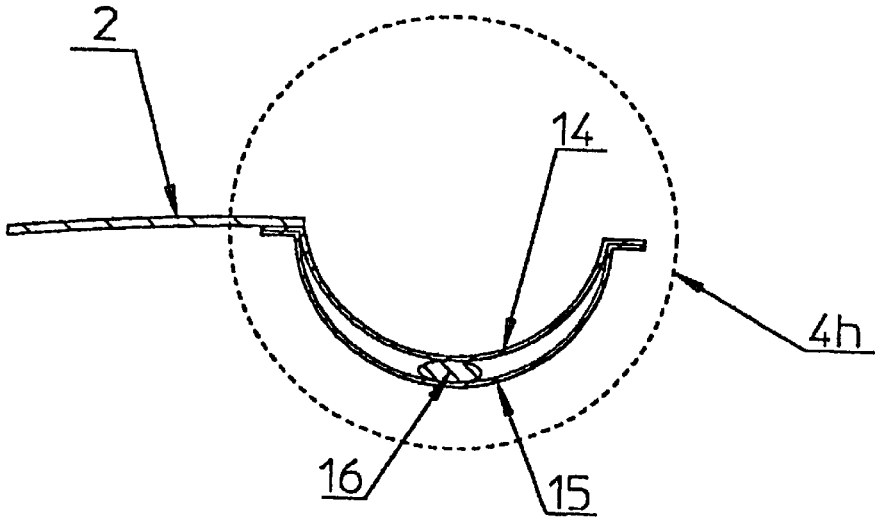
FIG. 20 is a cross-sectional view of a surround of a loudspeaker according to embodiment 5 of the present invention.

FIG. 20 is a cross-sectional view of a surround 4*h* of a loudspeaker according to embodiment 5 of the present invention. The loudspeaker of embodiment 5 has substantially the same structure as that of the loudspeaker 200 according to embodiment 1 shown in FIG. 1 except for the surround 4*h*. In FIG. 20, a reference numeral 14 denotes a first film, a reference numeral 15 denotes a second film, and a reference numeral 16 denotes a weight made of a material different from those of the first film 14 and the second film 15. The weight 16 is sandwiched by the first film 14 and the second film 15. The cross section of each of the first film 14 and the second film 15 has a generally half-circle shape. In the loudspeaker of embodiment 5, the ratio between the diameter p and the height h of a diaphragm 2 is set to (1:0.2) or greater.

In the loudspeaker of embodiment 5, the first film 14, the second film 15, and the weight 16 which is provided so as to be sandwiched by the films 14 and 15 form the surround 4*h*. The weight ratio between a vibrating section and the surround 4*h* is set so as to be within a range of 0.9:1 to 1.5:1. With such a setting of the weight ratio, a turbulence of the sound pressure level in the middle band, which occurs in a conventional loudspeaker using a thin-shaped diaphragm with a reduced height, can be removed, whereby a "flat" sound pressure frequency characteristic can be obtained. This effect is the same as those produced by the loudspeakers of embodiments 1 and 2.

Furthermore, the weight 16 for adjusting the weight of the surround 4*h* may be made of a high-density material (e.g., a metal) in view of the easiness of adjustment, or may be made of a material having a high internal loss or a material having a high viscosity (e.g., butyl rubber) for the purpose of improving an effect of suppressing an undesirable resonance in the surround 4*h*.

Furthermore, the weight 16 may be shaped in the form of one or more circles and provided in a gap between the first film 14 and the second film 15 concentrically with the surround 4*h*. Alternatively, the weight 16 may be shaped in the form of a plurality of lumps and provided in a gap between the first film 14 and the second film 15 according to a predetermined pattern or at random.

Since the surround 4*h* is structured such that the weight 16 is sandwiched by a plurality of films, there is no possibility that the weight 16 is dropped off from the surround 4*h*, and thus, a highly reliable structure is realized in the surround 4*h*.

Figure 21:
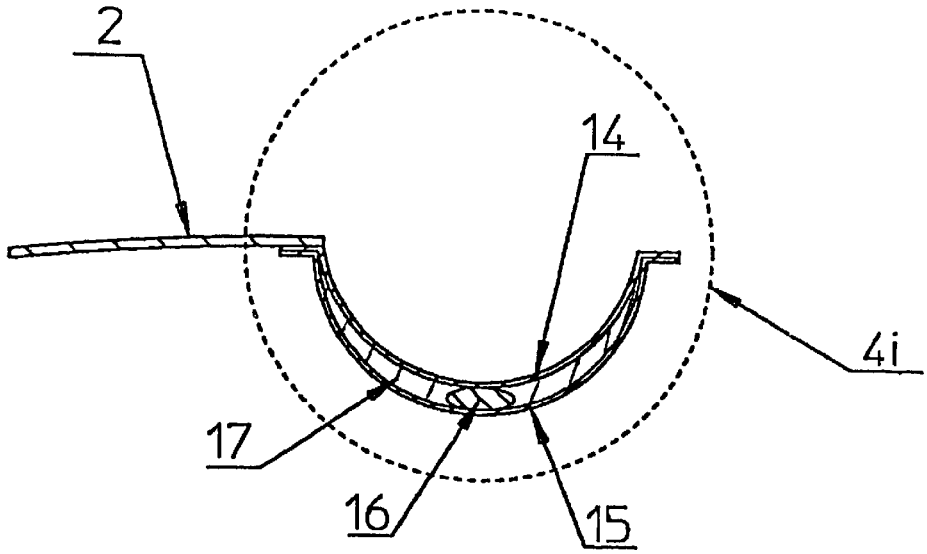
FIG. 21 is a cross-sectional view showing a variation of the surround of the loudspeaker shown in FIG. 20.

Further still, as shown in FIG. 21, a surround 4*i* may be structured such that the gap between the first film 14 and the second film 15 is filled with a damping material 17, such as a liquid, a liquid in the form of gel, or a viscoelastic body. In this case, an effect of suppressing an undesirable resonance in the surround 4*i* can be further improved for the sake of a damping effect produced by the damping material 17.

(Embodiment 6)

Figure 22:
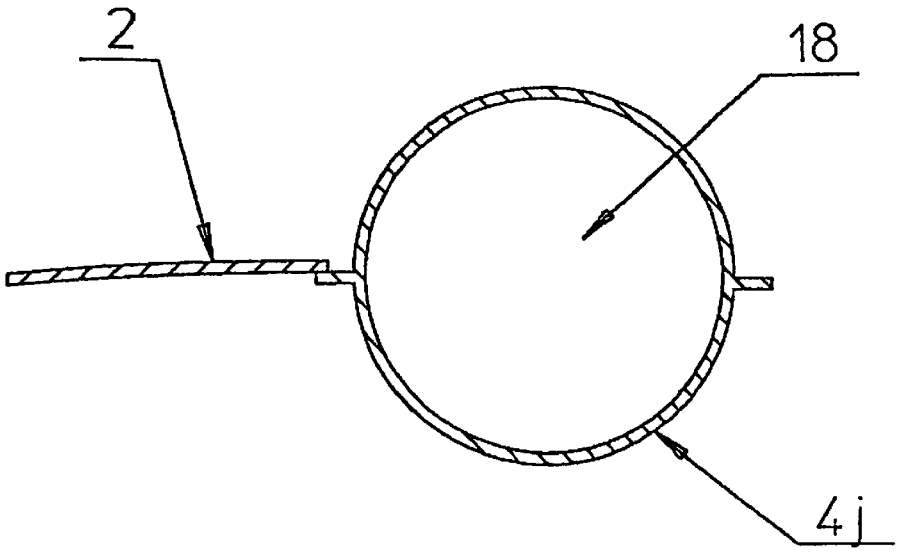
FIG. 22 is a cross-sectional view of a surround of a loudspeaker according to embodiment 6 of the present invention.

FIG. 22 is a cross-sectional view of a surround 4*j* of a loudspeaker according to embodiment 6 of the present invention. The loudspeaker of embodiment 6 has substantially the same structure as that of the loudspeaker 200 according to embodiment 1 shown in FIG. 1 except for the surround 4*j*. The cross section of the surround 4*j* of the loudspeaker according to embodiment 6 has a generally circle shape, and the surround 4*j* has a cavity 18. In the loudspeaker of embodiment 6, the ratio between the diameter p and the height h of a diaphragm 2 is set to (1:0.2) or greater.

In the loud speaker of embodiment 6, the surround 4*j* is shaped such that a cross-section thereof has a generally circle shape, so that the weight of the surround 4*j* is greater than that of the surround 104 of the conventional loudspeaker 100 (FIG. 24) whose cross-section has a generally half-circle shape. Thus, if the weight of the half-circular surround is insufficient, by using such a surround structure having a circular cross-section, the weight ratio between the vibrating section and the surround can be adjusted so as to be within a range of 0.9:1 to 1.5:1. With such a setting of the weight ratio, a turbulence of the sound pressure level in the middle band, which occurs in a conventional loudspeaker using a thin-shaped diaphragm with a reduced height, can be removed, whereby a "flat" sound pressure frequency characteristic can be obtained. This effect is the same as those produced by the loudspeakers of embodiments 1 and 2.

Furthermore, in the loudspeaker of embodiment 6, it is not necessary to provide a protrusion (as described in embodiments 3 and 4) or a weight (as described in embodiment 5) to the surround 4*j*. Therefore, the fabrication of the surround 4*j* is easier.

Figure 23:
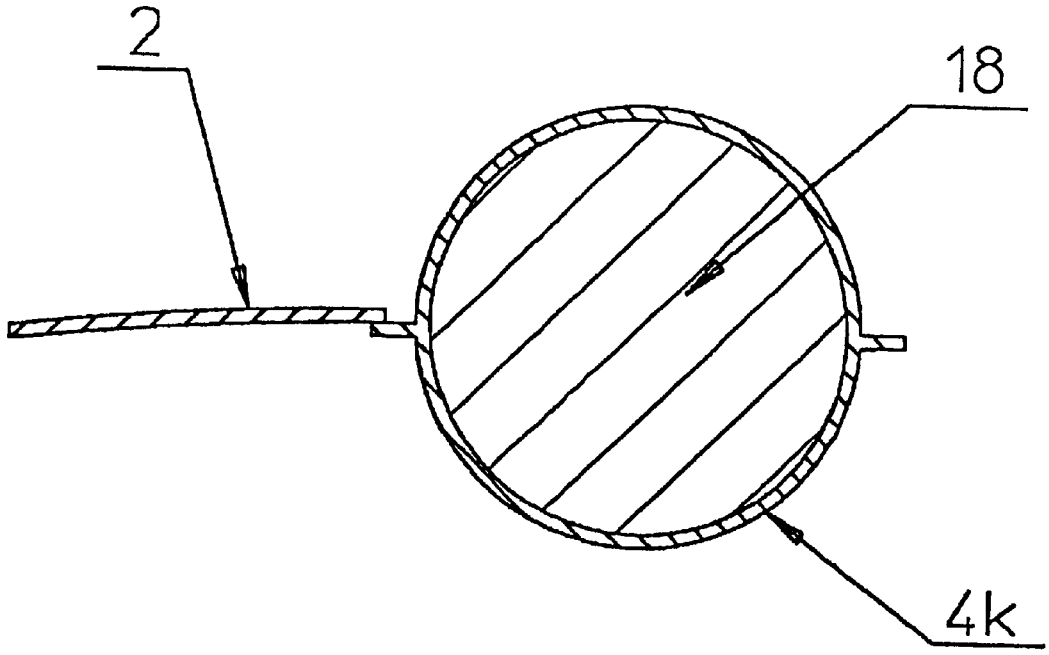
FIG. 23 is a cross-sectional view showing a variation of the surround of the loudspeaker shown in FIG. 22.

Furthermore, as shown in FIG. 23, the cavity 18 of a surround 4*k* may be filled with a damping material, such as a liquid, a liquid in the form of gel, or a viscoelastic body. In this case, an effect of suppressing an undesirable resonance in the surround 4*k* can be further improved for the sake of a damping effect produced by the damping material. Furthermore, if the weight of the surround 4*j* (FIG. 22) is insufficient, the weight ratio between the vibrating section and the surround can be adjusted with such a filled material so as to be within a range of 0.9:1 to 1.5:1.

According to the present invention, the weight ratio between a vibrating section and a surround of a loudspeaker is adjusted so as to be within a range of 0.9:1 to 1.5:1, whereby a turbulence of the sound pressure level in the middle band which occurs in a conventional loudspeaker can be removed. As a result, a "flat" sound pressure frequency characteristic can be obtained. The present invention is especially effective for a thin loudspeaker where the ratio between the diameter p and the height h of a diaphragm is (1:0.2) or greater.

Furthermore, the surround is provided with at least one protrusion; the surround is formed by first and second films each having a generally half-circle cross-section and a weight interposed therebetween; or the surround is structured so as to have a generally circular cross-section and is filled with a damping material, such as a liquid, a liquid in the form of gel, or a viscoelastic body. With such a structure, an undesirable resonance in the surround is suppressed, and accordingly, the quality of sound reproduced by the loudspeaker can be improved.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A loudspeaker, comprising:

a frame;

a vibrating section including a diaphragm having an internal periphery and an external periphery, a voice coil attached to the internal periphery of the diaphragm, a spider which connects the voice coil to the frame, and a dust cap attached to the internal periphery of the diaphragm; and a surround which connects the external periphery of the diaphragm to the frame, wherein the ratio between the weight of the vibrating section and the weight of the surround is 0.9:1 to 1.5:1.

2. A loudspeaker according to claim 1, wherein the ratio between the diameter of the diaphragm and the height of the diaphragm is (1:0.2) or greater.

3. A loudspeaker according to claim 1, wherein the vibrating section further includes a connector for connecting the diaphragm and the spider to the voice coil.

4. A loudspeaker according to claim 2, wherein:

a cross-section of the surround has a generally half-circle shape; and at least one protrusion is provided on the surround.

5. A loudspeaker according to claim 4, wherein the at least one protrusion is provided on the surround according to a predetermined pattern along a periphery of the surround.

6. A loudspeaker according to claim 4, wherein the at least one protrusion is provided on the surround at random.

7. A loudspeaker according to claim 4, wherein at least one of the at least one protrusion has a circular shape.

8. A loudspeaker according to claim 4, wherein the at least one protrusion is formed of a same material as that of the surround.

9. A loudspeaker according to claim 4, wherein the at least one protrusion is formed of a material different from that of the surround.

10. A loudspeaker according to claim 9, wherein an internal loss or viscosity of a material used in the protrusion is higher than that of a material used in the surround.

11. A loudspeaker according to claim 4, wherein the at least one protrusion is filled with a material which has a specific gravity greater than that of the surround.

12. A loudspeaker according to claim 2, wherein:

the surround includes a first film having a cross-section of a generally half-circle shape, a second film having a cross-section of a generally half-circle shape, and at least one weight formed of a material whose density is higher than those of the first and second films; and the at least one weight is sandwiched by the first and second films.

13. A loudspeaker according to claim 12, wherein:

a gap is provided between the first and second films; and the gap is filled with a liquid, a liquid in the form of gel, or a viscoelastic body.

14. A loudspeaker according to claim 2, wherein the surround has a cavity which has a cross-section of a generally circular shape.

15. A loudspeaker according to claim 14, wherein the cavity of the surround is filled with a liquid, a liquid in the form of gel, or a viscoelastic body.

* * * * *